United States Patent [19]

Schmidt et al.

[11] 4,307,854

[45] Dec. 29, 1981

[54] DISMOUNTABLE WIRE REEL

[75] Inventors: Karl-Gunther Schmidt, Coburg; Joachim Burkert, Neustadt, both of Fed. Rep. of Germany

[73] Assignee: Industriewerk Nachf. Seifert & Co. KG, Neustadt, Fed. Rep. of Germany

[21] Appl. No.: 135,376

[22] Filed: Mar. 31, 1980

[30] Foreign Application Priority Data

Mar. 30, 1979 [DE] Fed. Rep. of Germany ..... 2912806

[51] Int. Cl.[3] ..... B65H 75/22

[52] U.S. Cl. ..... 242/115; 242/110

[58] Field of Search ..... 242/110.1, 110.2, 115, 242/77, 77.4

[56] References Cited

U.S. PATENT DOCUMENTS

| | | | |
|---|---|---|---|
| 2,649,260 | 8/1953 | Beneke | 242/115 |
| 2,971,721 | 2/1961 | Jones | 242/110.2 |
| 4,221,347 | 9/1980 | Hill | 242/115 |

FOREIGN PATENT DOCUMENTS

| | | | |
|---|---|---|---|
| 2231483 | 1/1974 | Fed. Rep. of Germany | 242/110.1 |
| 651809 | 4/1951 | United Kingdom | 242/110.2 |

*Primary Examiner*—Leonard D. Christian

*Attorney, Agent, or Firm*—Jordan and Hamburg

[57] ABSTRACT

A dismantable reel for wire coils includes first and second circular flanges. An annular channel is formed at least in the first flange and a hub is supported within the channel for axial movement relative to the flange. A plurality of expandable and retractable core segments depend from the hub and are selectively engageable with the outer surface of a wire coil to retain the coil within the reel. An axial core tube is supported concentrically within the hub and is movable axially relative thereto. Spreadable link members are disposed between the core segments and the axial core tube. A hollow axle is carried rotatably by the hub within the axial core tube. Such axle is also movable axially relative to the hub. The lower end of the axle is threaded and is cooperable with threads provided on the second flange whereby the second flange is releasably connectable therewith.

12 Claims, 4 Drawing Figures

DISMOUNTABLE WIRE REEL

The invention relates to a dismantable wire reel for wire coils having a detachable flange and another flange to which is connected a core which includes a plurality of segments which can be spread apart in order to engage with the inner side of a wire-coil and thereby retain the coil on the reel.

When wires are drawn they are, according to the nature of their further processing, wound either upon dismantable reels or upon so-called solid reels. The advantage of solid reels for further processing is the high processing speed when the wire is withdrawn from the reel. Due to the fact that the solid reel is connected to the wire extending from the drawing works to the processing area, however, a plurality of reels in needed for storage and return of empty reels.

In conventional dismantable reels the flange carrying the collapsible core, which core consists of a plurality of segments, is connected to an opposite flange by threaded bolts. Before the wound coil is removed from this reel it is stabilized to create a self-supporting winding without a supporting carrier by the use of packing straps and are transported upon pallets. At the location where further processing is to take place the wire coil is unwound to the last turn by a flyer at conventional take-off speeds up to 6 m/sec.

The need exists to combine the advantages of both methods, namely by manufacturing ready-made coils of wire without supporting carriers which coils can be unwound for further processing without a flyer at as high a processing speed as possible, for instance at a speed of 40 m/sec. The invention achieves this by providing a dismantable wire reel which is particularly well adapted for use as a take-off reel and which allows the trouble-free processing of support-free wire coils even at high take-off speeds.

SUMMARY OF THE INVENTION

According to the invention a dismantable wire-reel of the aforementioned kind includes an axial core tube which is supported to be axially adjustable by and relative to the hub of the core flange, said axial core tube abutting on its inner side the outer wall of a hollow axle which is rotatable and axially adjustable. The axial core tube is connected on its outer side by means of spreadable links to core-segments, supported by the hub. The hollow axle has a bearing ring or flange which rests on the hub which limits its axial movement in the direction of the detachable flange. At its other end the hollow axle is threaded to cooperate with a threaded portion of the detachable flange.

Such a wire reel offers the advantage of a precisely centered support for a wire coil by the direct support of the core segments in relation to the hollow axle, such axle connecting both flanges of the reel in such a manner that the wire coil is supported therebetween with such axial tension as is needed in order to allow the trouble-free unwinding of the wire coil down to the last winding layer. The axial adjustment of the axial core tube actuates the spreadable links for the expansion and retraction of the core segments, because the core segments are supported by the hub whereas the axial core tube, on the contrary, is axially adjustable relative to the hub.

Such a wire reel may be inserted in a conventional take-off or unreeling mechanism which up to now was capable of only processing wire coils wound upon solid reels. Whereas an un-impeded process in the processing works requires only a few empty reels, the wire coils may be transported economically without supports, and the need to recycle empty reels becomes superfluous.

It is within the framework of the invention that the hub of the flange on the side of the core and/or at the detachable flange be supported by springs biased in the direction of each flange. The movement of the hub relative to the flange may, for example, actuate the axial adjustment of the axial core tube for the actuation of the core segments. On the other hand, spring control of the flanges guarantees trouble-free and secure engagement of the flanges with the wire coil, which frequently undergo a definite deformation when normally produced upon dismantable reels and transported without supports.

In order to expand upon this general idea a group of compression springs may be arranged in each case between the hub and the flange. In an additional embodiment of this idea the flanges have an annular groove in which is supported the annular hubs presenting an upside-down cup-shaped cross section. A group of compression springs are arranged between oppositely disposed circumferentially extending walls of the hub and flange and also a screw connection guides the path of the springs. The arrangement may consist of cup springs or helical springs positioned around threaded bolts which serve as guides. By the aid of nuts screwed onto the threaded bolts the maximum spring path desired each time may be adjusted as well as the desired tension of the groups of compression springs. Thus the spring path may be confined completely within the individual flange enabling simplification of the construction of the reel.

It was found to be particularly advantageous to provide the spreadable links between the axial core tube and the core segments in the form of parallel rods spaced from the axle. The links of these rods adjacent the core segments are capable of being radially shifted but they are solidly connected to the hub. The other side of the link is fastened to the axial core tube and may be, together with it, adjusted to be movable axially relative to the hub so that the core segments are movable radially by the axial motion of the axial core tube. The relative movement between hub and flange made possible by the previously mentioned spring arrangement does not impair this effect, because it acts only upon the links of the spreadable links at the side of the core segments.

According to another characteristic of the invention the hub of the flange at the side of the core has an internal neck protruding axially into the interior of the reel. Upon this neck is arranged in the direction of the axle a support for the radially shiftable links at the side of the core segments a radially inwardly extending support for the axial core tube and a ball or roller bearing for the hollow axle. The concentric support of the axial core tube relative to the hollow axle makes superfluous any additional support of these elements upon the oppositely disposed detachable flange.

In an additional embodiment of the invention the axial core tube is given radially inwardly directed grooves and the hollow axle is furnished in the area of these grooves with corresponding openings so that a "crab" may be attached to the axial core tube from the inside of the core and may be capable together with it of lifting the wire coil and, if need be, the whole reel.

A roller bearing arranged between the hub and the hollow axle serves to rotatably support the hollow axle upon the hub of the flange on the side of the core. This bearing accepts the axial pressure when the hollow axle is screwed to the detachable flange and transfers this pressure to the hub and from the hub to such flange by means of the aforementioned springs, so that the wire coil is maintained under adequate axial tension between the flanges.

It was found particularly advantageous when the inner neck of the hub of the flange at the side of the core is provided with two collar-shaped radially inwardly directed and axially spaced stop members. An outwardly directed check ring on the axial core tube extends between these collar-shaped stop members in order for support of the axial core tube upon the hub. The hub of the detachable flange, on the other hand, has an inner ring which serves as a limit stop member for a check ring which is arranged at the opposite axial end of the axial core tube in order to limit thereby the axial movement of the axial core tube as a function of its proximity to both flanges.

According to another characteristic of the invention the free end of the hollow axle, adjacent the detachable flange has an outer thread and the hub of the detachable flange is internally threaded to cooperate with it. The threaded end of the hollow axle may be provided with an outer taper and the threaded portion of the hub may be provided with a cooperable tapered portion in order to guarantee dependable meshing of both elements when the core is seated upon the detachable flange and in order to protect the threads from being damaged between the hollow axle and the hub of the detachable flange.

BRIEF DESCRIPTION OF THE DRAWINGS

Further characteristics, details and advantages of the invention will result from the following description of a preferred embodiment of the invention with the aid of the drawing in which.

DESCRIPTION OF THE PREFERRED EMBODIMENTS

Figure 1:
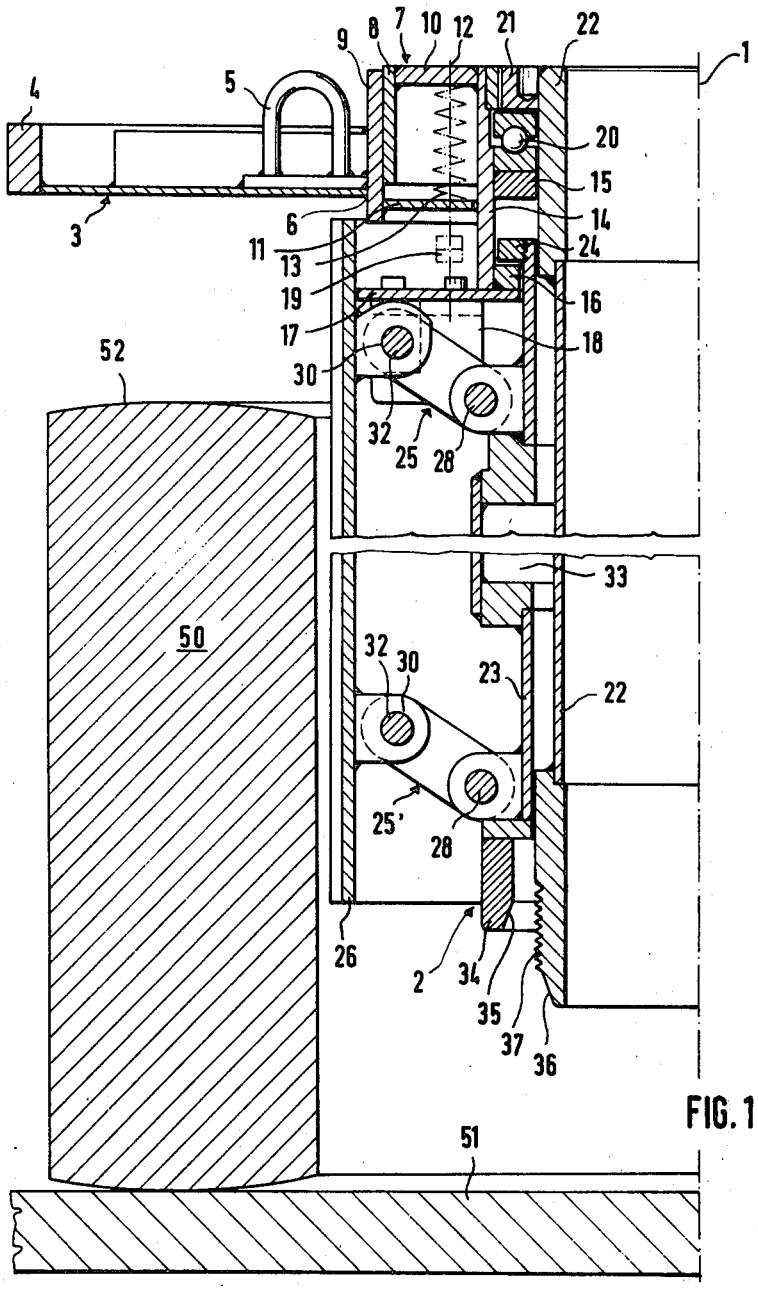
FIG. 1 is a longitudinal cross-sectional view, which shows the introduction of the core of the reel into a wire coil that is resting upon a pallet.

Only a portion of the wire reel is shown in all figures because it is substantially symmetrical relative to its central axis 1.

The wire reel shown in the drawings consists of a flange 3 connected to a core 2, said flange 3 being provided with a reinforcing ring 4 and jack rings 5 at its outer side. A hub 7 is positioned within an annular groove 6 or channel of the flange 3 in such a manner that a collar 8 of a ring-shaped wall 9 lies within groove 6 and a circumferential wall 10 of the hub 7 opposes a corresponding circumferential bottom wall 11 of the groove 6. Both circumferential walls are connected to each other by threaded bolts 12, each of said threaded bolts 12, being surrounded by a helical spring biased between walls 10 and 11. An inner axial neck 14 of the hub 7 extends into the interior of the reel and carries on its radial inner side stop members 15 and 16 and on its axial inner end a support 17 having a bearing plate 18. The threaded bolts 12 are screwed into the wall 10 of hub 7 and into the support 17. Two lock nuts 19 are screwed on to the bolts between support 17, and the wall 11. A ball or roller bearing 20 is disposed upon the stop member 15 at the radial inner side of the inner neck 14 of hub 7, said bearing 20 serving as a support for an outwardly projecting bearing ring 21 of a hollow axle 22.

Hollow axle 22 is supported within the core so that it may be shifted longitudinally. On its outer wall abuts an axial core tube 23 having an outwardly directed check ring 24 which extends into the space between the stop members 15 and 16 of hub 7. Such construction allows the axial core tube 23 to be supported in an axially movable manner. The axial core tube 23 carries by means of spreadable links 25, arranged in pairs, a plurality, for instance eight, core segments 26. Two guides 27 of each spreadable link are connected by a bolt 28 to lugs 29 on core tube 23. Link 30 of the spreadable link 25 (at the top in FIG. 1) is supported for radial movement in a guide 31 of the bearing plate 18. Furthermore, a bearing pin 32 follows in its movements the movements of support 17 produced by the compression springs 13. The lower spreadable links 25' are constructed similarly to the upper ones but do not afford radial movement of the link 30 on the side of the core segment.

Figure 2:
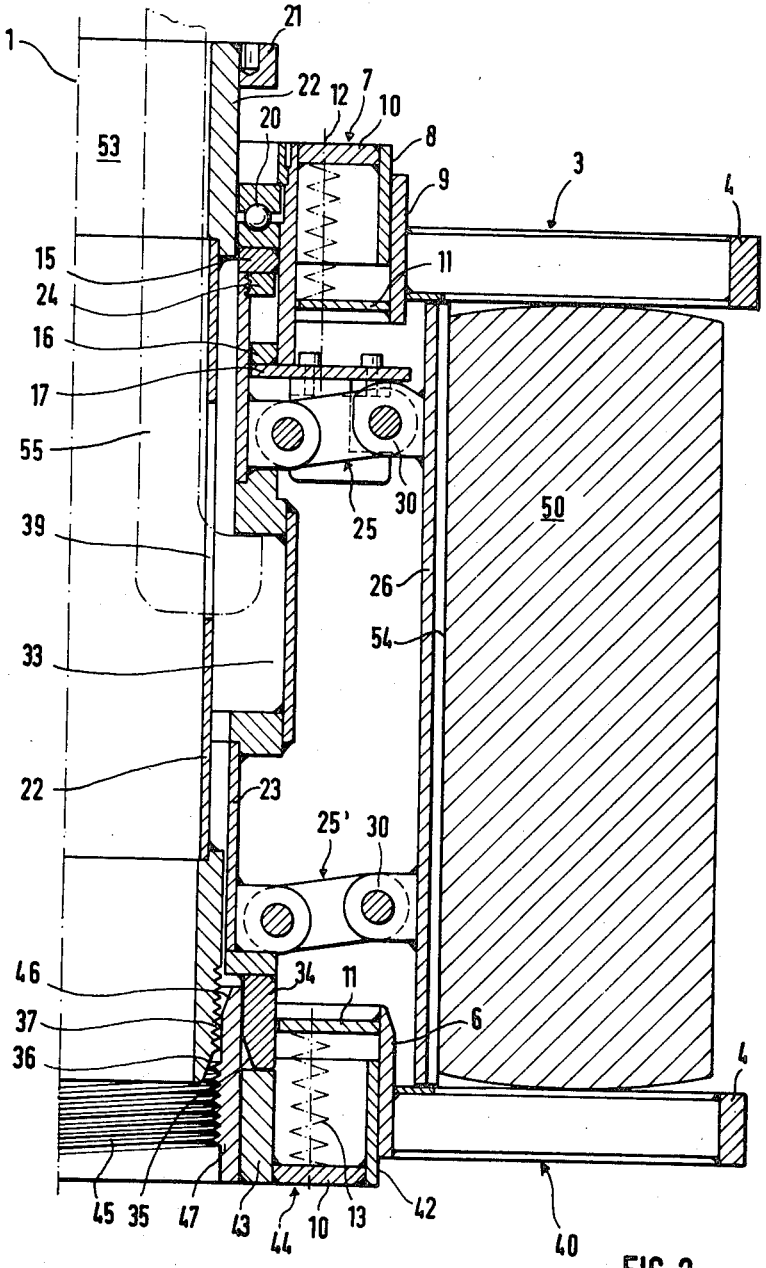
FIG. 2 is a longitudinal cross-sectional view, which shows the coil seated upon the detachable flange supported by the core of the reel.

The axial core tube 23 has a radially inner groove 33 which is accessible through corresponding openings 39 in the hollow axle 22, so that crane hooks 55 may enter from the inside (see FIG. 2). The axial core tube 23 carries at its lower end a check ring 34 having an inner taper 35. Correspondingly the lower end of the hollow axle 22 is furnished with an outer taper 36 which merges into an axial external thread 37.

Figure 3:
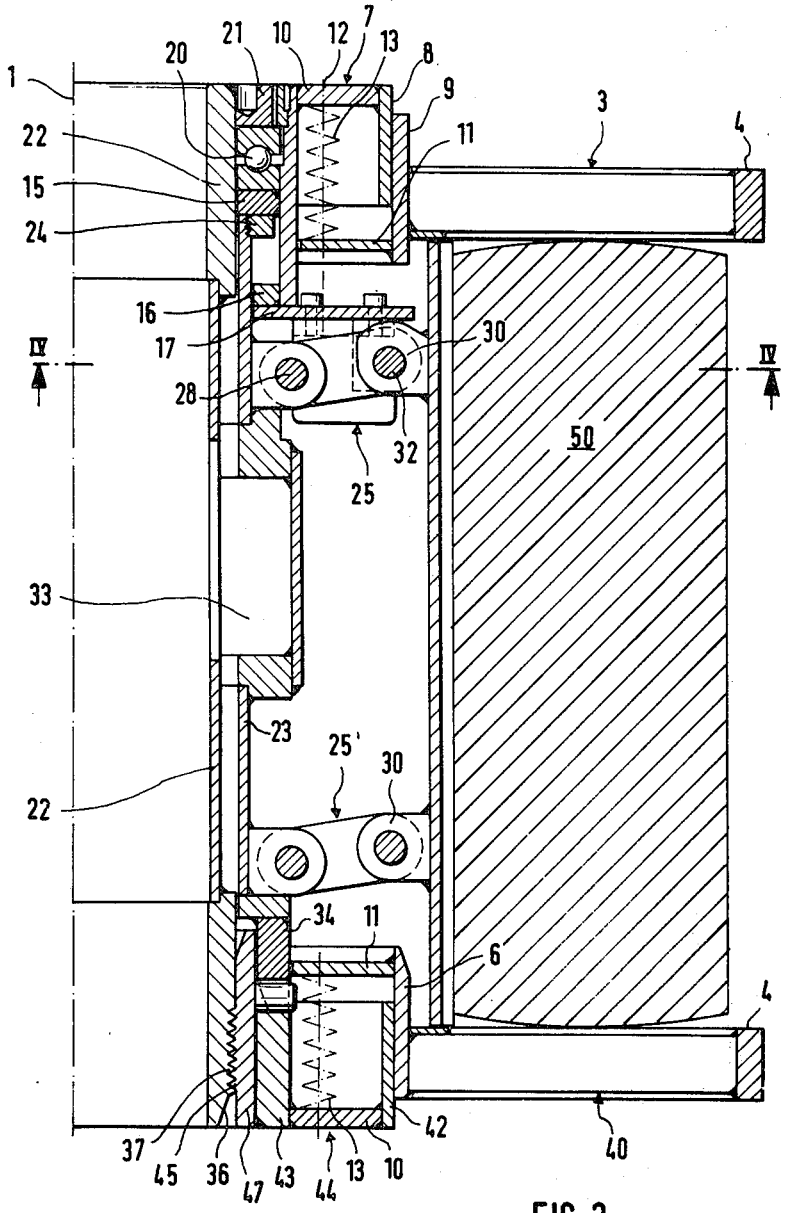
FIG. 3 is a longitudinal view, partly in cross-section showing the connecting of both flanges to each other by means of the hollow axle.
Figure 4:
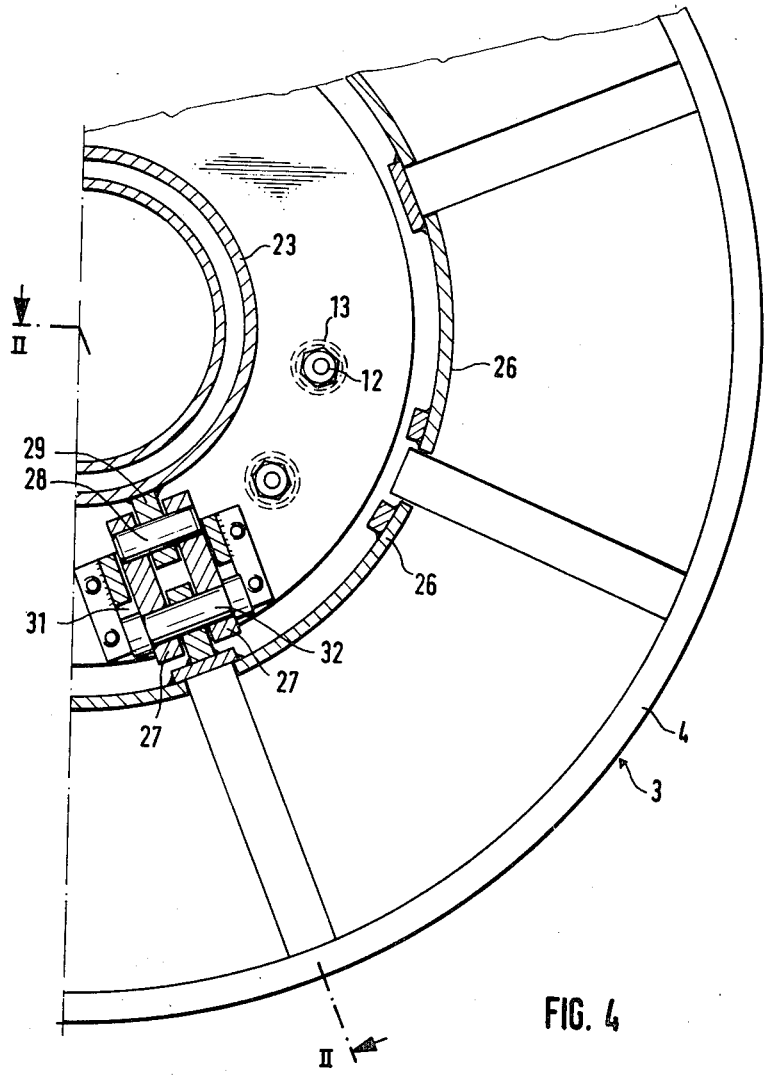
FIG. 4 is a section taken along the line IV—IV of FIG. 3.

The detachable flange 40 of the wire reel shown in FIGS. 2 and 3 of the drawing is also furnished with an outer reinforcing ring 4 and an annular groove 6. The circumferential wall 11 opposes the corresponding wall 10 of a hub 44. They are analogous to the construction of hub 7 and are connected to each other by threaded bolts 12, each of such bolts guiding a compression spring 13. An inner ring 43 of hub 44 serves as a limit stop for the check ring 34 of the axial core tube 23 when the core 2 is set upon the detachable flange 40. It abuts at its inside a threaded ring 47 furnished with an internal thread 45 and an inner taper 46 at its axial inner extremity.

The wire reel functions as follows:

The coil or wire winding 50 initially rests upon a pallet 51 (shown in simplified form). The unit consisting of core 2 and flange 3, suspended from the jack ring 5 is introduced into the inner space of the wire coil 50, as shown in FIG. 1. Consequently hub 7 is urged upwardly by the compression springs 13 into an upper position so that links 30 of the spreadable links 25, disposed adjacent the core segments, are also raised whereby the axial core tube 23 drops into the position shown in FIG. 1 with check ring 24 supported on stop member 16. That causes the spreadable links 25 to maintain the core segments 26 in the shown retracted position, in other words the core segments 26 form a minimal diameter circle. Finally the flange 3, disposed at the side of the core, descends until it reaches the upper frontal plane 52 of the wire coil 50 so that it rests thereon. The crane gear (not shown) is pulled out of the jack ring 5.

A lifting jack, whose hook 55 is shown in FIG. 2, enters the inner bore 53 of the hollow axle 22 and engages in the groove 33 of the axial core tube 23 by entering the opening 39 of the hollow axle 22. Lifting of the hook 55 at first results in lifting of the axial core tube 23. That causes the spreadable links 25 to spread apart and to effect solid engagement of the core segments 26 with the inner wall 54 of the wire coil 50. When the crane hook 55 is lifted higher the wire coil 50 is lifted off the pallet (not shown in FIG. 2). It is disposed in this position as shown in FIG. 2, upon the detachable flange 40. While this happens, the check ring 34, guided by its inner taper 35, rides over the threaded ring 47 of the hub 44 and engages with the limit stop 43 of the hub 44 of detachable flange 40. Thereby the axial core tube 23 will be continually held in its raised position, even when the hook 55 releases it. Spreadable links 25 remain spread so that the core segments 26 are held in gripping engagement with the wire coil 50.

After the hooks 55 of the crane gear have been pulled out, the thread 37 of the hollow axle may be screwed into the internal thread 45 of the hub 44 until the wire coil 50 is well pressed between the two flanges 3 and 40, by compression springs 13. The wire coil can now easily be handled in this position. It may, for instance be turned or set in a take-off device, and the coil of wire may be unwound at maximum speed. Once unwinding of the wire is finished, the core segments 26 loosen their grip on the wire coil 50, so that all tension is released. Screwing of hollow axle 22 out of the hub 44 of the detachable flange 40 of the wire reel allows its immediate re-use.

We claim:

1. A dismantable reel for wire coil comprising:

a first flange;

a hub supported by said flange for relative axial movement relative thereto;

a plurality of core segments depending from said hub adapted to be expanded radially into engagement with the radially inner surface of a wire coil to retain said coil within the reel and to be retracted radially to initially accommodate the coil within the reel;

an axial core tube supported by said hub for axial movement relative thereto and extending concentrically within said core segments;

spreadable link members connecting said axial core tube and said core segments;

a hollow axle carried rotatably by said hub concentrically within said axial core tube, said hollow axle being movable axially relative to said hub, said hollow axle having a threaded section thereon adjacent its extremity remote from said flange; and a second flange provided with a threaded section cooperable with the threaded section of said hollow axle for releasably connecting said second flange thereto.

2. A reel according to claim 1, wherein at least said first flange is circular and said first flange is provided with an annular channel therein, said hub being positioned within said channel.

3. A reel according to claim 2, wherein said hub has a generally inverted cup-shaped configuration in cross-section, said channel including a circumferentially extending bottom wall and said hub including a circumferentially extending wall which is generally parallel to and spaced above the bottom wall of said channel, spring means being positioned between said walls, and bolts extending through said walls within said spring means for axially guiding same.

4. A reel according to claim 1, wherein said spreadable link members comprise upper and lower sets of same, said hub having a depending bearing plate, said bearing plate having guide means thereon and said upper link members being supported so as to be cooperable with said guide means and movable radially and axially in response to movement of said hub.

5. A reel according to claim 1, wherein said hub includes an axial radially inner neck which extends interiorly of the reel, said neck having a pair of axially spaced radially inwardly projecting stop members, said axial core tube having a radially outwardly projecting ring member positioned beween said stop members and engageable with same to define the axial movement of said axial core tube relative to said hub.

6. A reel according to claim 5, wherein rotable bearing means is supported by the upper of said stop members, said hollow axle having a radially outwardly projecting flange adjacent the upper extremity thereof, said flange being supported on said upper stop member whereby the hollow axle is supported rotatably by said hub.

7. A reel according to claim 1, wherein grooves are formed on the radially inner surface of said axial core tube and corresponding openings are formed in said hollow axle.

8. A reel according to claim 1, wherein said second flange is provided with a radially inner ring member which is engageable by the lower end of said axial core tube to limit the downward axial movement thereof in the positioning of the reel on the wire coil.

9. A reel according to claim 1, wherein said second flange is circular and is provided with an annular channel therein, a hub being positioned within such channel, said channel having a circumferentially extending bottom wall and said hub having a circumferentially extending wall which is generally parallel to and spaced below said bottom wall, spring means being positioned between said walls, and bolts connected between said walls serving as axial guides for said spring means.

10. A reel according to claim 9, wherein the threaded section of said second flange is formed on the radially inner surface of the hub thereof.

11. A reel according to claim 10, wherein the lower extremity of said hollow axle and the upper extremity of the threaded section of the hub of said second flange are provided with complementary and cooperable tapered portions.

12. A reel according to claim 1, wherein such core segments extend in circumferentially spaced relation radially ouwardly of said axle core tube.

* * * * *